US005263712A

United States Patent [19]

Lo

[11] Patent Number: 5,263,712

[45] Date of Patent: Nov. 23, 1993

[54] GAME RACKET HAVING FIBER REINFORCED SHAFT

[76] Inventor: Pi-Tuan Lo, No. 96, Sec. 4, Pei-Ping Rd., Taichung City, Taiwan

[21] Appl. No.: 946,725

[22] Filed: Sep. 18, 1992

[51] Int. Cl.[5] ..... A63B 49/02

[52] U.S. Cl. ..... 273/73 G; 273/73 D

[58] Field of Search ..... 273/73 R, 73 C, 73 D, 273/73 G, 73 J

[56] References Cited

U.S. PATENT DOCUMENTS

| | | | |
|---|---|---|---|
| 4,138,109 | 2/1979 | Nobbs | 273/73 G |
| 4,196,901 | 4/1980 | Durbin | 273/73 G |
| 4,322,076 | 3/1982 | Bertram et al. | 273/73 D |
| 4,826,167 | 5/1989 | Lo | 273/73 G X |
| 4,988,101 | 1/1991 | Soong | 273/73 D |
| 5,020,800 | 6/1991 | Chen | 273/73 G |
| 5,050,944 | 10/1991 | Janes | 273/73 G |
| 5,092,594 | 3/1992 | Jang | 273/73 R |
| 5,141,228 | 8/1992 | Soong | 273/73 G X |

FOREIGN PATENT DOCUMENTS 2243790 11/1991 United Kingdom .

*Primary Examiner*—V. Millin
*Assistant Examiner*—Raleigh W. Chiu
*Attorney, Agent, or Firm*—Browdy and Neimark

[57] ABSTRACT

A game racket comprises a head with a stringed surface and a shaft connected with the head and provided with a handle. The shaft further has a throat piece adjacent to a yoke of the head. The throat piece is provided with two arms arranged in a V-shaped fashion. Located between the throat piece and the handle is a connecting portion, which comprises a through hole traversing the short axis of the shaft and parallel to the direction of the stringed surface. Similarly, each of the two arms of the throat piece is provided with a through hole. Each of the through holes is provided with an elastic shock-absorbing body inserted thereinto. The stringed surface is composed of a plurality of long strings, which are fastened to the elastic shock-absorbing bodies. As a result, the shock energy generated by the stringed surface upon hitting a ball is effectively absorbed and attenuated by the elastic shock-absorbing bodies.

6 Claims, 2 Drawing Sheets

GAME RACKET HAVING FIBER REINFORCED SHAFT

BACKGROUND OF THE INVENTION

The present invention relates to a game racket, and more particularly to a game racket having a fiber reinforced shaft designed specifically for absorbing shock effectively.

It is a well-known fact that a game racket of the prior art often brings about the so-called elbow injury to the hand of a player holding such game racket. With a view to mitigating the shock wave of the game racket upon hitting a ball, a U.S. Pat. No. 4,826,167 discloses a game racket having fiber-reinforced shaft provided with a window located at the upper end of the handle of a hollow construction. A synthetic foam core is lodged in the window so as to enhance the flexibility of the game racket and to reduce slightly the rigidity of the game racket. In other words, the foam core serves dual purposes of preventing the shaft from breaking and of mitigating the transmission of shock by the shaft.

Another prior art method of reducing the shock transmission by a game racket is disclosed in a United States Patent (pending, with a filing number of 07/535,840). This disclosure deals with a method by which the vibration of the string is rapidly attenuated. Such deed is accomplished by means of the shock-absorbing block or the shock-absorbing elongate body, which is fastened to the string. However, such method is defective in that the shock-absorbing block or body can not attenuate the shock wave that has been already transmitted to the racket frame, and that the shock-absorbing block or body is vulnerable to becoming detached from the string to which it is fastened.

A British Patent 9009831.0 (filed on May 2, 1992) discloses a game racket comprising a head portion and a shaft, which are coupled by means of a shock-absorbing material serving to mitigate the shock wave that is transmitted from the head portion to the shaft. Such method is defective in design in that the structural integrity of the game racket is undermined by the shock-absorbing material which is used to couple the head portion and the shaft. It is often difficult to select a shock-absorbing material which has an appropriate hardness to safeguard simultaneously the rigidity and the shock-absorbing effect of the game racket.

There is still another U.S. Pat. No. 5,092,594 disclosing a shock-absorbing means of game racket handle. Such shock-absorbing means may be also mounted on the head frame of the racket.

SUMMARY OF THE INVENTION

It is, therefore, the primary objective of the present invention to provide a game racket having a fiber-reinforced shaft capable of absorbing simultaneously the shock wave coming from the string and the shock wave coming from the head frame.

In keeping with the principles of the present invention, the foregoing objective of the present invention is accomplished by a game racket, which has a fiber-reinforced shaft and comprises a head with a stringed surface and a shaft that is coupled with the head and provided with a handle at one end thereof. The shaft is provided at another end thereof with a throat piece which is connected with the head and has two arms arranged in a V-shaped pattern. Located between the two arms and the handle is a connecting portion, while located between the head frame and the throat piece is a yoke. The shaft of the present invention is characterized in that the connecting portion is provided with a through hole arranged in such manners that it is parallel to the cross-strings of the stringed surface and that it traverses the short axis of the shaft. Another two through holes are disposed respectively in the portions of two arms adjacent to the connecting portion. These three through holes are each provided with an elastic shock-absorbing body. Those strings forming the stringed surface and passing through the yoke are arranged in such a manner that they pass through the elastic shock-absorbing body of the arm and are then bent toward the side of the shaft after passing through the elastic shock-absorbing body of the connecting portion and is further bent toward another elastic shock-absorbing body of the arm before being placed into the throat piece. Thereafter, the strings pass through the yoke to enter the head frame. As a result, those strings making up the sweet spot pass through these three elastic shock-absorbing bodies.

The shock wave generated by the stringed surface of the head upon hitting a ball is effectively absorbed by the elastic shock-absorbing bodies. In addition, the shock wave transmitted via the strings to the head frame is also effectively attenuated by the elastic shock-absorbing bodies.

DETAILED DESCRIPTION OF THE PREFERRED EMBODIMENT

Figure 1:
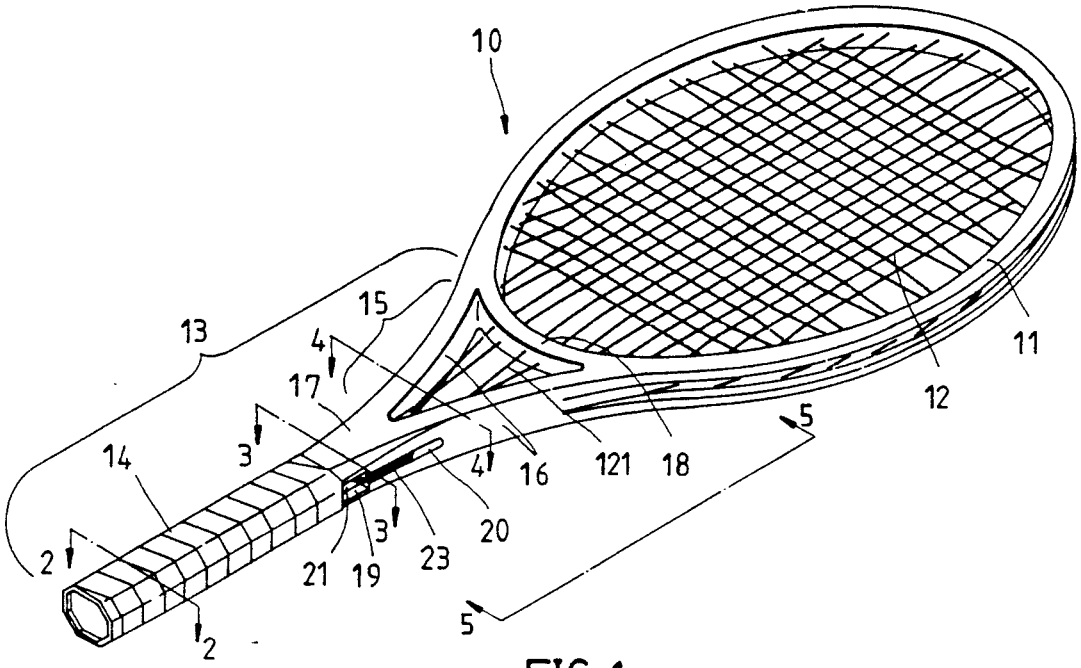
FIG. 1 shows a perspective view of a game racket embodied in the present invention.
Figure 2:
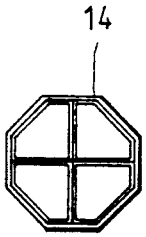
FIG. 2 shows a sectional view of a portion taken along the line 2—2 as shown in FIG. 1.
Figure 3:
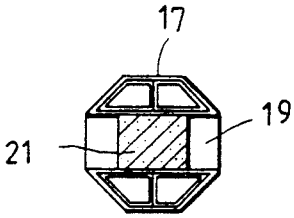
FIG. 3 shows a sectional view of a portion taken along the line 3—3 as shown in FIG. 1.
Figure 4:
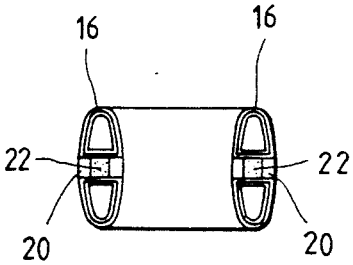
FIG. 4 shows a sectional view of a portion taken along the line 4—4 as shown in FIG. 1.

Referring to all drawings provided herewith, a game racket 10 embodied in the present invention is shown to comprise a head 11 having a stringed surface 12, and a shaft 13 connected to the head 11 and provided with a handle 14 as a hand grip. In addition, the game racket 10 is provided with a throat piece 15 having two arms 16 arranged in a V-shaped pattern. Located between the throat piece 15 and the handle 14 is a connecting portion 17. A yoke 18 is disposed between the throat piece 15 and the frame of the head 11. The connecting portion 17 is provided with a through hole 19 traversing the short axis of the shaft 13 in the direction parallel to the cross-strings of stringed surface 12. Similarly, each of the two arms 16 of the throat piece 15 is also provided with a through hole 20. Each of these three through holes 19 and 20 contains respectively an elastic shock-absorbing body 21 or 22 inserted thereinto. The elastic shock-absorbing bodies 21 and 22 are made of polyethylene elastic rubber and provided with a predetermined number of independent through holes 210 and 220 for strings to pass through. Two grooves 23 communicating respectively with the through holes 19 and 20 are disposed in two locations of the shaft 13 situated between the through hole 19 of the connecting portion 17 and the through holes 20 of the arms 16. The long strings 121 passing through the yoke 18 to form the stringed surface 12 are allowed to enter the throat piece 15 and then to pass through a through hole 220 of the elastic shock-absorbing body 22 of the arm 16 before emerging from one side of the shaft 13 and further then to pass through, via the groove 23, the independent through hole 210 of the shock-absorbing body 21 of the connecting portion 17 so as to pass through, via another groove 23, the independent through hole 220 of the arm 16 before entering again the throat piece 15 to return to the frame of the head 11 via the yoke 18. As a result, those strings making up the sweet spot of the stringed surface 12 are so arranged as to pass through the three elastic shock-absorbing bodies 21 and 22.

Upon hitting a ball, the stringed surface 12 is capable of transmitting rapidly the impact energy to the elastic shock-absorbing bodies 21 and 22 via the long strings 121. In addition, the shock wave transmitted to the frame of the head 11 from the stringed surface 12 is also effectively attenuated by the elastic shock-absorbing bodies 21 and 22.

Figure 6:
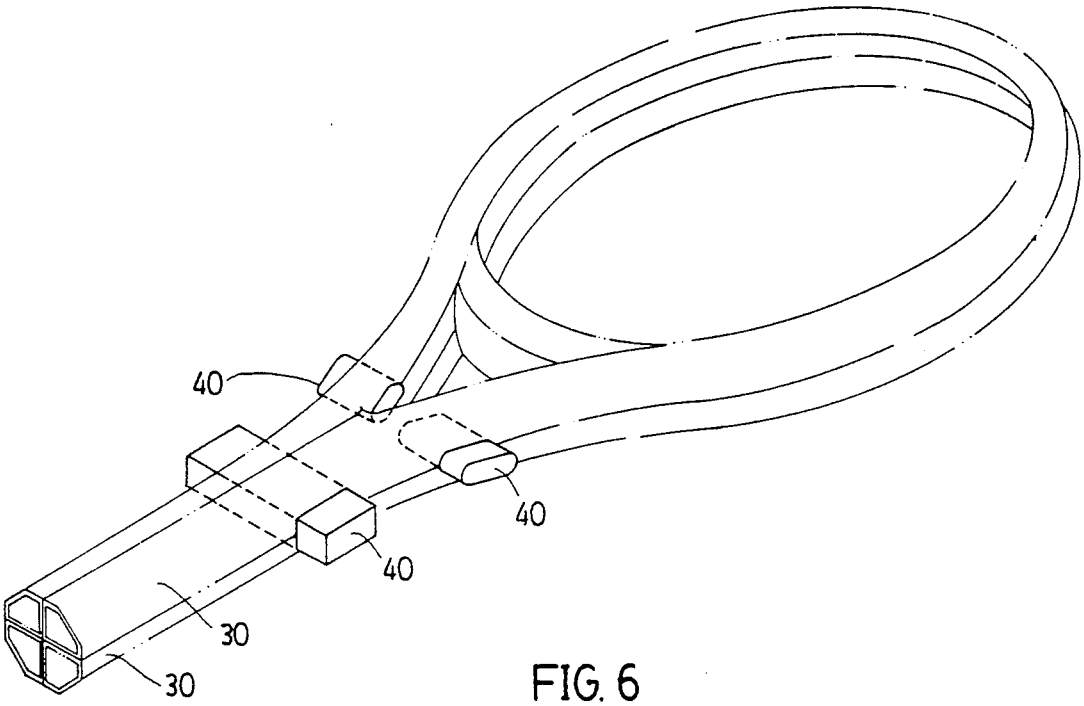
FIG. 6 shows a schematic view of making the embodiment of the present invention.
Figure 5:
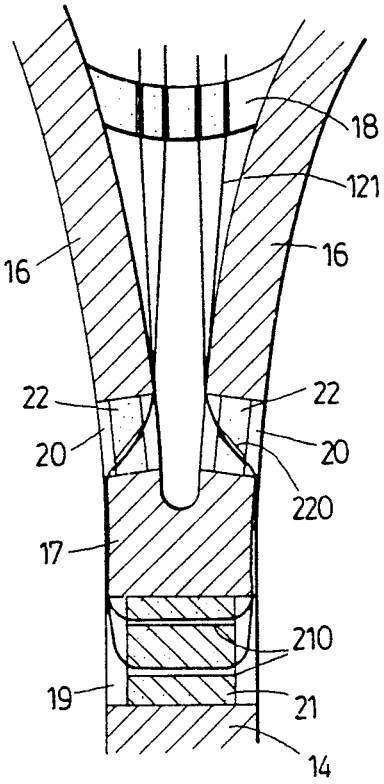
FIG. 5 shows a sectional view of a portion taken along the line 5—5 as shown in FIG. 1.

As shown in FIG. 6, the through holes 19 and 20 are made integrally with the racket frame and are not drilled after the production of the racket frame. As a result, the structural strength of the racket frame is not undermined. The method of making such racket frame includes two blow tubes wrapped respectively and windingly with the carbon fiber fabric sheets preimpregnated in epoxy resin. Such blow tubes 30 are then arranged in such a manner that one is atop another before they are placed in a mokding tool, which is not shown in the drawing. Located between the two blow tubes 30 and at the positions corresponding to the three through holes 19 and 20 are three mandrels 40. Each of the two blow tubes 30 has a sealed end and an open end through which a high pressure gas is blown into so as to cause the blow tube 30 to expand to force the carbon fiber fabric covering thereon to adhere to the inner wall of the molding tool and to the mandrels 40. Upon the completion of the heating under a pressure for a period of time and upon the completion of the curing process of the resin, the molding tool is opened to remove therefrom a racket frame having the integrally made through holes 19 and 20. The manderels 40 must be withdrawn from the racket frame so made.

It must be noted here that the elastic bodies 22 that are inserted into the two arms 16 must be made of a material soft enough to absorb effectively and rapidly the impact energy of the strings hitting a ball, such as polyethylene elastic rubber made by foam molding. However, the elastic shock-absorbing body 21 of the connecting portion 17 is preferably made of a material having an appropriate hardness to withstand the tension of the strings hitting a ball.

What is claimed is:

1. A game racket comprising a fiber reinforced shaft and a head with a stringed surface, said shaft being coupled with said head and provided with a handle as a hand grip and being further provided with a throat piece adjacent to said head and having two arms arranged in a V-shaped pattern, with a connecting portion arranged between said throat piece and said handle, said head further comprising a frame having a yoke facing said throat piece; wherein said shaft is characterized in that said connecting portion is provided with a through hole traversing a short axis of said shaft and parallel to the direction of the cross-strings of said stringed surface, and that each of said two arms is provided with a through hole traversing said short axis of said shaft and parallel to the direction of the cross-strings of said stringed surface, with each of said through holes provided with an elastic shock-absorbing body inserted thereinto; and wherein said stringed surface is composed of a plurality of long strings which are arranged in such a manner that they pass through said yoke to enter said throat piece and subsequently said elastic shock-absorbing body of one of said two arms before emerging from a side of said shaft, and then to enter said elastic shock-absorbing body of said connecting portion before emerging again from another side of said shaft, and further then to enter said elastic shock-absorbing body of another one of said two arms before entering again said throat piece so as to return to said frame of said head via said yoke.

2. The game racket of claim 1 wherein said elastic shock-absorbing bodies are provided with a plurality of through holes corresponding in number and location to said long strings.

3. The game racket of claim 1 wherein said elastic shock-absorbing body contained in said connecting portion has a hardness greater than a hardness of said elastic shock-absorbing bodies contained respectively in said two arms.

4. The game racket of claim 1 wherein said through hole of said connecting portion and said through holes of said two arms are made integrally with said shaft.

5. The game racket of claim 1 wherein said elastic shock-absorbing bodies are made of polyethylene elastic rubber by foam molding.

6. The game racket of claim 1 wherein said game racket is made from two blow tubes, which are wrapped windingly and respectively with fiber fabric sheets preimpregnated in epoxy resin and which are stacked one stop another in a molding tool to be heated under a pressure to take the form of said game racket having said through holes made integrally by a plurality of mandrels prearranged between said two blow tubes.

* * * * *